US005306117A

United States Patent [19]

Bear et al.

[11] Patent Number: 5,306,117

[45] Date of Patent: Apr. 26, 1994

[54] AXIAL INLET BEAM-TYPE COMPRESSOR

[75] Inventors: Clayton Bear; Robert A. Peterson, both of Calgary, Canada

[73] Assignee: NOVA Corporation of America, Calgary, Canada

[21] Appl. No.: 986,290

[22] Filed: Dec. 7, 1992

[30] Foreign Application Priority Data

Dec. 23, 1991 [CA] Canada ..... 2058395

[51] Int. Cl.[5] ..... F01D 9/04

[52] U.S. Cl. ..... 415/142; 415/191; 415/208.2; 415/209.2; 415/229; 415/199.2

[58] Field of Search ..... 417/406; 415/142, 144, 415/185, 191, 198.1, 199.1, 199.2, 199.3, 208.1, 208.2, 209.2, 210.1, 229

[56] References Cited

U.S. PATENT DOCUMENTS

| | | | |
|---|---|---|---|
| 2,540,968 | 2/1951 | Thomas | 414/142 |
| 3,449,653 | 6/1969 | Koppelmann . | |
| 3,558,238 | 10/1968 | Van Herpt . | |
| 3,758,226 | 9/1973 | Gyurech . | |
| 3,846,039 | 11/1974 | Stalker | 415/208.2 |
| 4,492,518 | 1/1985 | Neal | 415/142 |
| 4,993,917 | 2/1991 | Kulle et al. | 415/105 |
| 5,141,389 | 8/1992 | Bear et al. | 415/112 |

FOREIGN PATENT DOCUMENTS

| | | | |
|---|---|---|---|
| 0923102 | 4/1963 | United Kingdom | 415/191 |

*Primary Examiner*—Edward K. Look
*Assistant Examiner*—Christopher Verdier
*Attorney, Agent, or Firm*—Bruce E. Harang

[57] ABSTRACT

A rotary fluid machine suitable for transferring energy between a fluid and a rotor assembly is disclosed. The rotor assembly contains a shaft carrying one or more impellers which are located between axially spaced radial bearings in a beam-type arrangement. The rotary fluid machine is of the beam type—i.e. it has one end of the shaft extending beyond one end wall of the housing and one end of the shaft terminating within the housing. Two passages are formed in the housing to allow fluid to flow in and out of the machine. One passage is formed in the housing parallel to and coaxial with the rotational axis of the rotor assembly. Fluid moving between the passage parallel to and coaxial with the rotational axis does not have to be redirected thus reducing fluid turbulence and improving machine efficiency.

5 Claims, 2 Drawing Sheets

AXIAL INLET BEAM-TYPE COMPRESSOR

FIELD OF THE INVENTION

The present invention relates to a rotary fluid machine arrangement characterized by a rotor assembly of a beam-type arrangement used in combination with a housing containing one opening parallel to and coaxial with the rotational axis of the rotating mechanical assembly.

BACKGROUND OF THE INVENTION

Rotary fluid machines are used in a wide variety of applications to transfer energy between fluid passing through the machine and a rotating mechanical assembly. In general, a rotary fluid machine has a housing with a fluid duct extending through the housing and one or more rotor assemblies which rotate within the fluid duct. In operation, the rotation of the rotor assemblies cause a difference in fluid pressure between the inlet and outlet of the fluid duct.

Rotary fluid machines are generally of either a beam-type configuration or of an overhung-type arrangement. U.S. Pat. No. 3,558,238 shows a typical rotary fluid machine of the overhung-type configuration. U.S. Pat. No. 3,758,226 shows a typical rotary fluid machine of the beam-type configuration.

In a typical beam-type machine, a shaft which forms part of the rotating assembly extends beyond both ends of the housing. Radial bearing assemblies are provided at each end of the housing to support the shaft in the housing while allowing the shaft to freely rotate about a rotational axis which extends along the length of the shaft and is generally parallel to the center of the shaft. A shaft seal assembly is located in either and of the housing at the point where the shaft passes through the housing. The shaft seal assembly restricts the passage of fluid between the inside and outside of the housing at the point where the shaft passes through the housing. Attached to and rotatable with the shaft are one or more impellers through which fluid passes. Rotary fluid machines of a beam-type configuration often have several impellers on the shaft. Several impellers are commonly used when a large difference between inlet fluid pressure and discharge fluid pressure exists. Typical impellers are designed such that fluid enters the impeller through an annular passage generally at the inner diameter of the impeller which is coaxial with the axis of rotation of the shaft. To provide a means for moving fluid in and out of the housing, inlet and discharge fluid passages are formed in the housing. Often these passages formed in the housing are positioned such that fluid entering the machine through the passage enters the fluid duct perpendicular to the axis of rotation of the shaft. After entering the fluid duct, the fluid must be aligned with the annular passage at the inlet of the impeller. The redirection of the fluid causes turbulence within the fluid stream which results in a pressure drop and a corresponding loss in machine efficiency.

A rotary fluid machine of the overhung configuration has a shaft forming part of the rotating assembly which extends beyond one end of the housing. Radial bearing assemblies are located in the end of the housing which the shaft passes through. The radial bearing assemblies support the shaft in the housing while allowing the shaft to freely rotate about the axis of rotation. The shaft is, therefore, supported in cantilever fashion. Attached to the section of shaft within the fluid duct are one or more impellers of similar design to the impellers of a beam-type machine. The impellers are typically of relatively large size and weight. When an impeller is mounted on the shaft being supported in cantilever fashion, high radial forces must be resisted by the bearing assemblies. Large bearing forces require large capacity radial bearings which are often undesirable. The problem of large radial bearing forces can be especially acute when more than one impeller is placed on the shaft to form a multistage rotary fluid machine. Overhung rotary fluid machines are therefore often limited to one or two impellers.

A fluid passage can be formed in the end of the housing the shaft does not extend through, such that fluid moving through the passage enters the machine parallel to and coaxial with the axis of rotation of the shaft, and therefore, does not have to be redirected into the impellers. The turbulence and associated loss of machine efficiency due to the redirection of the fluid is substantially avoided.

It is, therefore, apparent that a rotary fluid machine with a fluid passage coaxial with the shaft axis of rotation, and with the impellers located between the radial bearing assemblies, would be a useful addition to the art.

SUMMARY OF THE INVENTION

According to the present invention there is provided a rotary fluid machine comprising a housing which defines a fluid duct, and a rotating assembly supported by first and second bearing assemblies, said rotating assembly having a shaft with one end extending through one end wall of said housing and the second end terminating within said fluid duct, at least one radial bearing within said first radial bearing assembly and located in the end wall of the housing said shaft extends through, said rotary fluid machine being characterized by having a bearing frame positioned within said fluid duct and comprising a plurality of radial limbs extending between said housing and said second radial bearing assembly, said second radial bearing assembly comprising at least one radial bearing, at least one impeller attached to and rotatable with said shaft wherein said impeller is positioned between said first and second radial bearing assemblies and said housing having a fluid passage formed in it to allow passage of fluid through said housing, said passage being coaxial with the rotational axis of said rotating assembly.

DETAILED DESCRIPTION OF THE INVENTION

Embodiments of the invention will now be described by way of example only with reference to the accompanying drawings in which;

BRIEF DESCRIPTION OF THE DRAWINGS

Referring to FIG. 1, a rotary fluid machine (which is a gas compressor in this embodiment) has a housing 10 within which fluid duct 11 is formed.

Figure 1:
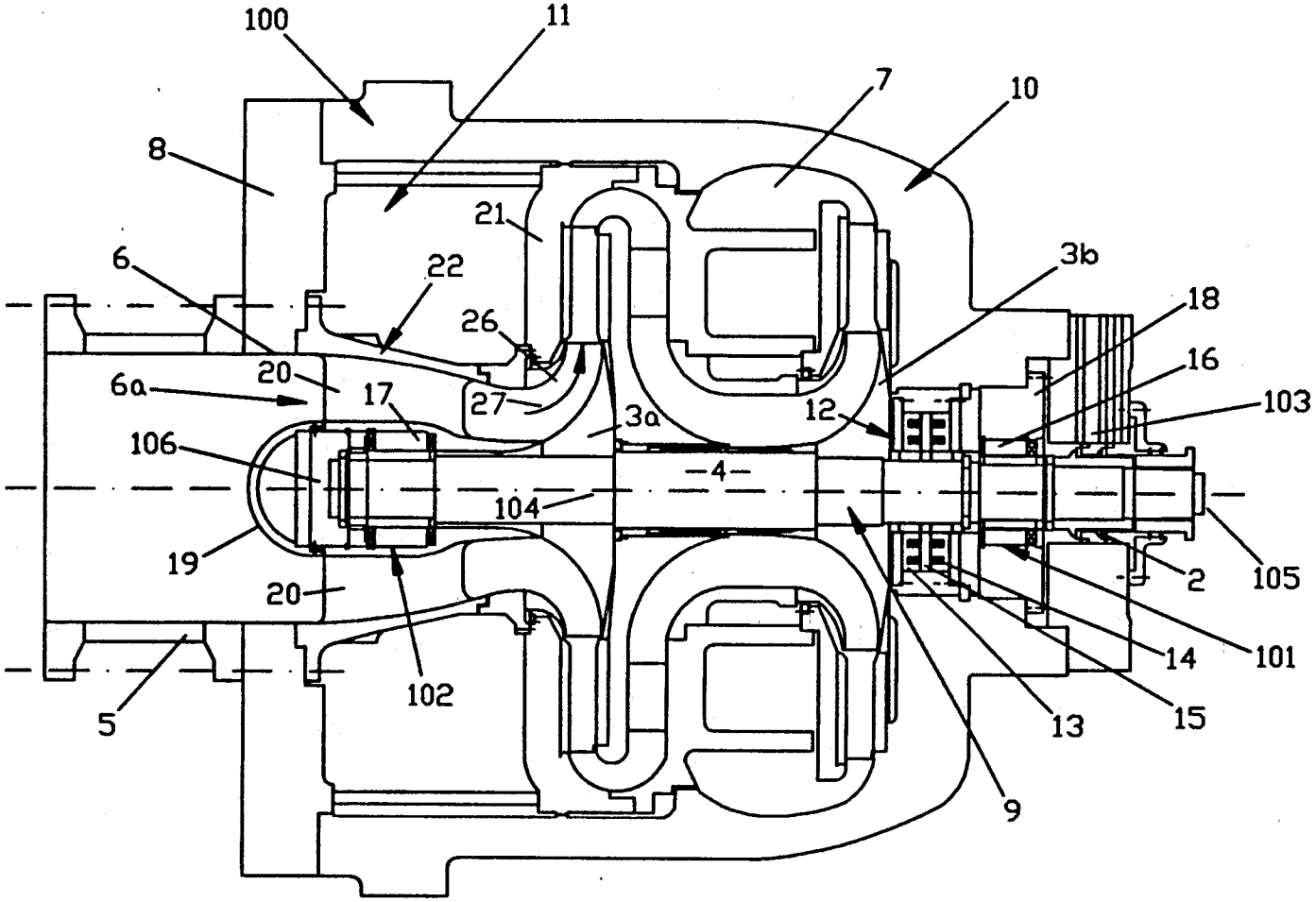
FIG. 1 is a sectional view of a Axial Inlet Beam-Type Compressor according to this invention and, FIG. 2 is an end view of the inlet bearing frame.

Fluid duct 11 extends from door 8 to exit volute 7. Inlet passage 6 is formed in door 8 to allow fluid passing through inlet piping 5 to enter the gas compressor.

Rotor assembly 9 consists of shaft 4 and impellers 3*a* and 3*b* which are attached to and rotatable with shaft 4. To maintain the rotor assembly in the desired axial position (with respect to the housing) axial bearing assembly 12 is provided. The axial bearing assembly includes magnetic bearing thrust stators 13 and 14 attached to housing 10 and thrust disc 15 attached to and rotatable with shaft 4. The axial bearing assembly opposes axial forces imposed on the rotor in either axial direction to maintain the shaft at the desired datum. The axial bearing assembly is of a generally conventional design and is described in for example U.S. Pat. No. 4,180,296. To restrict the flow of fluid from the housing at the point where the shaft passes through the housing, a fluid seal assembly 2 is located between the housing 10 and shaft 4. The fluid seal assembly may be of the gap type as described for example in U.S. Pat. No. 3,499,653.

To maintain the rotor assembly in the desired radial position, radial magnetic bearings 16 and 17 are provided at axially spaced locations on the rotor assembly 9 such that impellers 3*a* and 3*b* are between of said radial magnetic bearings. The radial magnetic bearings are of generally conventional design and are further described in for example U.S. Pat. No. 4,302,061.

Radial magnetic bearing 16 is held by radial magnetic bearing housing 18 which in turn is attached to housing 10. This mounting arrangement provides rigid radial support for the radial magnetic bearing. Rigid radial support for radial magnetic bearing 17 is provided through inlet bearing frame 22. The inlet bearing frame is fixed to door 8.

Figure 2:
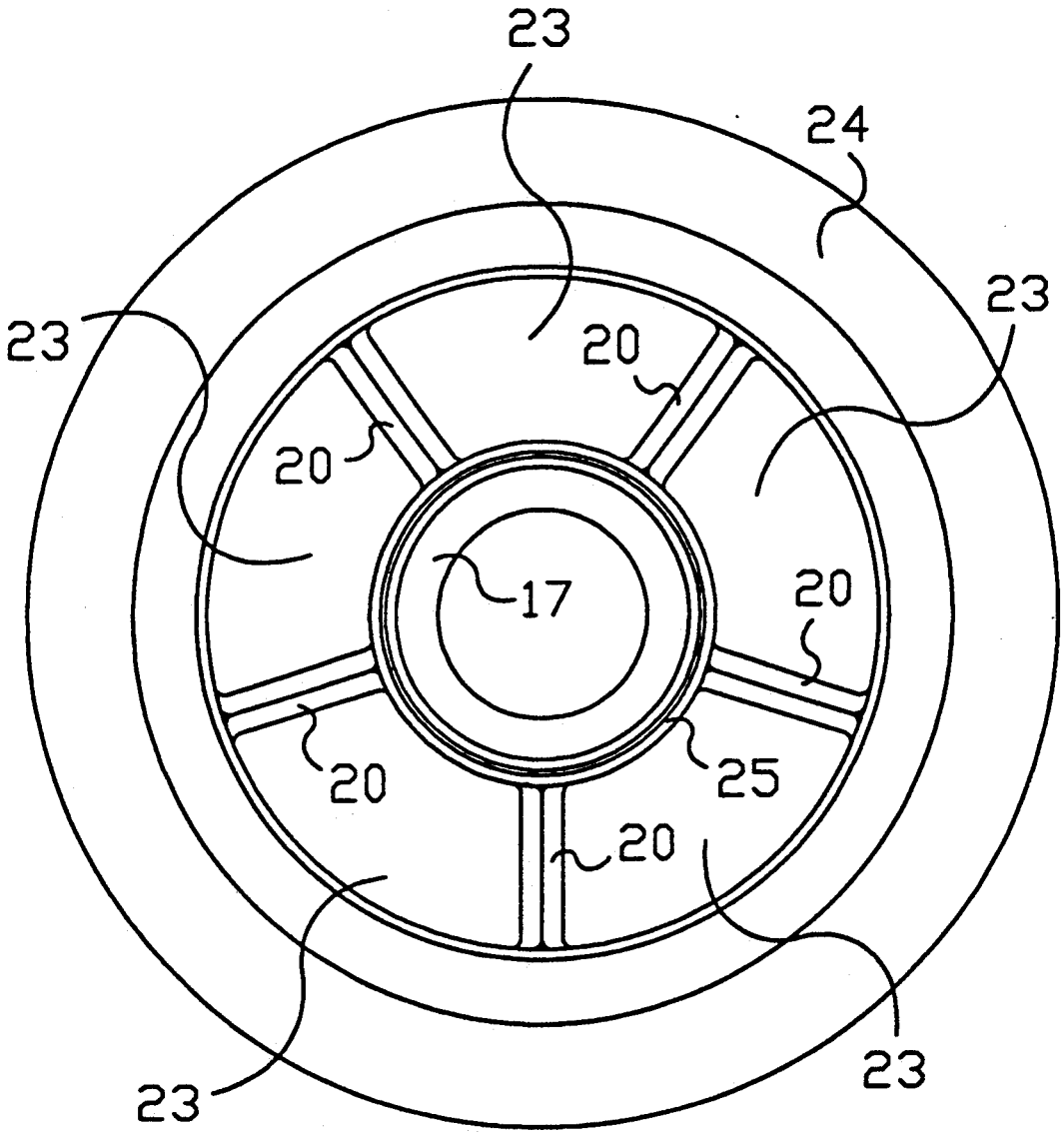

The features of inlet bearing frame 22 can best be seen on FIG. 2. Radial magnetic bearing 17 is encircled by bearing retaining ring 25. Bearing retaining ring 25 is connected to mounting ring 24 by a plurality of radially extending limbs 20. A preferred method of constructing the inlet bearing frame is to make the inlet bearing frame as a one piece metal casting. When made as a one piece casting, the inlet bearing frame forms a rigid support for radial magnetic bearing 17. Limbs 20 cooperate with bearing retaining ring 25 and mounting ring 24 to define fluid channels 23. These fluid channels allow fluid entering the machine to flow through the bearing inlet frame towards the impellers. A preferred design of the limbs is one in which the limbs are contoured such that they minimize their obstruction to fluid passing through the inlet bearing frame. A further preference would be to smooth the surfaces of the limbs and the surfaces of the bearing retaining ring and the mounting ring. Smoothing these surfaces reduces the friction between the surface and the fluid passing over the surface, therefor.

During operation, fluid in piping 5 enters the gas compressor through inlet passage 6, thus allowing fluid flow in the direction indicated by arrow 6*a*. The inlet passage 6 thus allows fluid flow in a direction which is parallel to and coaxial with the axis of rotation of the rotor assembly. To prevent gas entering the compressor through passage 6 from impinging upon the end of shaft 4 or radial bearing 17, deflector 19 is attached to inlet bearing frame 22 ahead of limbs 20. Deflector 19 is contoured to allow a smooth redirection of fluid around the shaft and bearing and into fluid channels 23.

Fluid exiting fluid channels 23, enters impeller 3*a* through annular opening 26 near the inner diameter of the impeller. Energy is transferred from the impeller to the fluid as the fluid passes through the impeller along a path generally represented by arrow 27. Fluid exits the impeller perpendicular to the axis of rotation and enters interstage diffuser 21. The interstage diffuser serves to redirect the fluid into impeller 3*b* where additional energy is transferred to the fluid similar to the process occurring at impeller 3*a*. After exiting impeller 3*b*, the fluid enters exit volute 7 where it is directed out of housing 10 through a discharge fluid passage (not shown).

The use of a magnetic bearing within the fluid duct is a preferred embodiment, however, the use of alternate bearing types such as rolling element or hydrodynamic bearings are possible. With bearing systems which require lubrication, a method to prevent the process fluid and the lubricants from mixing may be necessary.

The present invention resides in the novel means of providing beam type support to a rotor assembly while still allowing the communication of fluid between the inner diameter of the impellar and the external fluid passage along a generally straight line. It is to be understood that the invention therefore is meant to encompasses both of (a) a rotary fluid machine originally designed and built as a axial inlet beam type machine and (b) a conventionally designed rotary fluid machine which has undergone modifications which result in the machine being of the axial inlet beam type arrangement.

It will be understood by those knowledgeable in the art of rotary fluid machines that the axial inlet beam-type rotary fluid machine described herein is only one example of an axial inlet beam type machine. That is, numerous variations in the fluid machine are possible which maintain the axial inlet beam-type style. The possible variations include but are not limited to a different number of impellers and different interstage diffuser arrangements. In certain applications it may be desirable to locate fluid seal 2 behind impeller 3*b*. Axial bearing assembly 12 and radial magnetic bearing 16 would then be located farther away from impeller 3*b* and would not be exposed to the pressurized fluid contained within housing 10. These variations typically depend on the specific application the rotary fluid machine is used in.

What is claimed is:

1. A rotary fluid machine containing:

(a) a housing which defines a fluid duct; and (b) a rotating assembly supported by first and second radial bearing assemblies, said rotating assembly having a shaft having a rotational axis, wherein one end of said shaft extends through one end wall of said housing and the second end of said shaft terminates within said fluid duct, and wherein at least one radial bearing within said first radial bearing assembly is located in the end wall of the housing which said shaft extends through; wherein said rotary fluid machine is further defined by:

(i) having a bearing frame positioned within said fluid duct and comprising a plurality of radial limbs extending between said housing and said second radial bearing assembly, wherein said second radial bearing assembly comprises at least one radial bearing;

(ii) having at least one impeller attached to and rotatable with said shaft wherein said impeller is positioned between said first and second radial bearing assemblies; and (iii) said housing having a fluid passage formed in it to allow passage of fluid through said housing, wherein said passage is coaxial with the rotational axis of said rotating assembly.

2. The rotary fluid machine according to claim 1 wherein said second radial bearing assembly contains at least one radial magnetic bearing.

3. The rotary fluid machine according to claim 1 wherein said first radial bearing assembly contains at least one magnetic radial bearing.

4. The rotary fluid machine according to claim 3 wherein said second radial bearing assembly contains at least one radial magnetic bearing.

5. The rotary fluid machine according to claim 1 wherein said rotary fluid machine is a gas compressor.

* * * * *

UNITED STATES PATENT AND TRADEMARK OFFICE

CERTIFICATE OF CORRECTION

PATENT NO. : 5,306,117

DATED : April 26, 1994

INVENTOR(S) : Bear et al.

It is certified that error appears in the above-indentified patent and that said Letters Patent is hereby corrected as shown below:

Title Page, Column 1, section [73] Assignee
Delete "NOVA Corporation of America" and
Insert --NOVA Corporation of Alberta-- therefor.

Signed and Sealed this

Thirteenth Day of September, 1994

*Attest:*

*Attesting Officer*

BRUCE LEHMAN

*Commissioner of Patents and Trademarks*